US007774962B1

(12) United States Patent
Ladd

(10) Patent No.: US 7,774,962 B1
(45) Date of Patent: Aug. 17, 2010

(54) REMOVABLE AND REUSABLE TAGS FOR IDENTIFYING BOTTLES, CANS, AND THE LIKE

(76) Inventor: David Ladd, 8775 Summerfield Rd, Petersburg, MI (US) 49270

( * ) Notice: Subject to any disclaimer, the term of this patent is extended or adjusted under 35 U.S.C. 154(b) by 0 days.

(21) Appl. No.: 12/148,835

(22) Filed: Apr. 23, 2008

Related U.S. Application Data

(60) Provisional application No. 60/926,579, filed on Apr. 27, 2007.

(51) Int. Cl.
*G09F 3/00* (2006.01)

(52) U.S. Cl. ..... 40/310; 215/286

(58) Field of Classification Search ..... 40/310, 40/324, 661.12, 673, 331; 215/365, 386, 215/399

See application file for complete search history.

(56) References Cited

U.S. PATENT DOCUMENTS 275,432 A * 4/1883 Stanly ..... 40/310
1,353,531 A * 9/1920 Heard ..... 40/310
1,796,398 A * 3/1931 Richardson ..... 116/308
2,930,155 A * 3/1960 Becker ..... 40/665
D344,763 S * 3/1994 Vitantonio et al. ..... D20/28
5,555,655 A * 9/1996 Yager et al. ..... 40/306
D374,408 S * 10/1996 McMillan ..... D10/109
D412,938 S * 8/1999 Kesselring et al. ..... D20/28
2003/0226298 A1 12/2003 Bjork
2005/0138854 A1 6/2005 Simmons
2005/0235532 A1 * 10/2005 Eberl et al. ..... 40/310

* cited by examiner

*Primary Examiner*—Cassandra Davis
(74) *Attorney, Agent, or Firm*—MacMillan, Sobanski & Todd, LLC

(57) ABSTRACT

A removable and reusable tag for identifying bottles, cans, and the like includes a ring portion having an outer circumferential surface and an intermediate circumferential surface. A tab portion extends radially between the intermediate circumferential surface and an inner circumferential surface and is circumferentially bounded by at least one recess provided therein. An identification portion is provided on the outer circumferential surface.

10 Claims, 3 Drawing Sheets

REMOVABLE AND REUSABLE TAGS FOR IDENTIFYING BOTTLES, CANS, AND THE LIKE

CROSS-REFERENCE TO RELATED APPLICATIONS

This application claims the benefit of U.S. Provisional Application No. 60/926,579 filed Apr. 27, 2007, the disclosure of which is incorporated herein by reference.

BACKGROUND OF THE INVENTION

This invention relates to an improved structure for a removable and reusable tag for identifying bottles, cans, and the like.

It is conventional for children or teenagers to drink soft drinks out of a can or a bottle. The contents of each container is intended to be consumed by one person only and usually contains about 350 ml. That quantity is chosen because, under normal circumstances, it is sufficient to quench the thirst of an average teenager or child who is approaching his teens. Where there are a number of young persons gathered together, such as at a party, each young person is usually offered one can or bottle with the intention that he or she will consume the entire contents of the container before requesting another. However, in the excitement and confusion of a party, the young person may put a bottle or can down before he or she has finished its contents and, as a result, may be unable to find it later. In such circumstances, the young person will usually open another can or bottle, and the unconsumed contents of the first container will be wasted. Thus, it would be desirable to provide a removable and reusable tag for identifying bottles, cans, and the like.

SUMMARY OF THE INVENTION

This invention relates to an improved structure for a removable and reusable tag for identifying bottles, cans, and the like. The tag includes a ring portion having an outer circumferential surface and an intermediate circumferential surface. A tab portion extends radially between the intermediate circumferential surface and an inner circumferential surface and is circumferentially bounded by at least one recess provided therein. An identification portion is provided on the outer circumferential surface.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
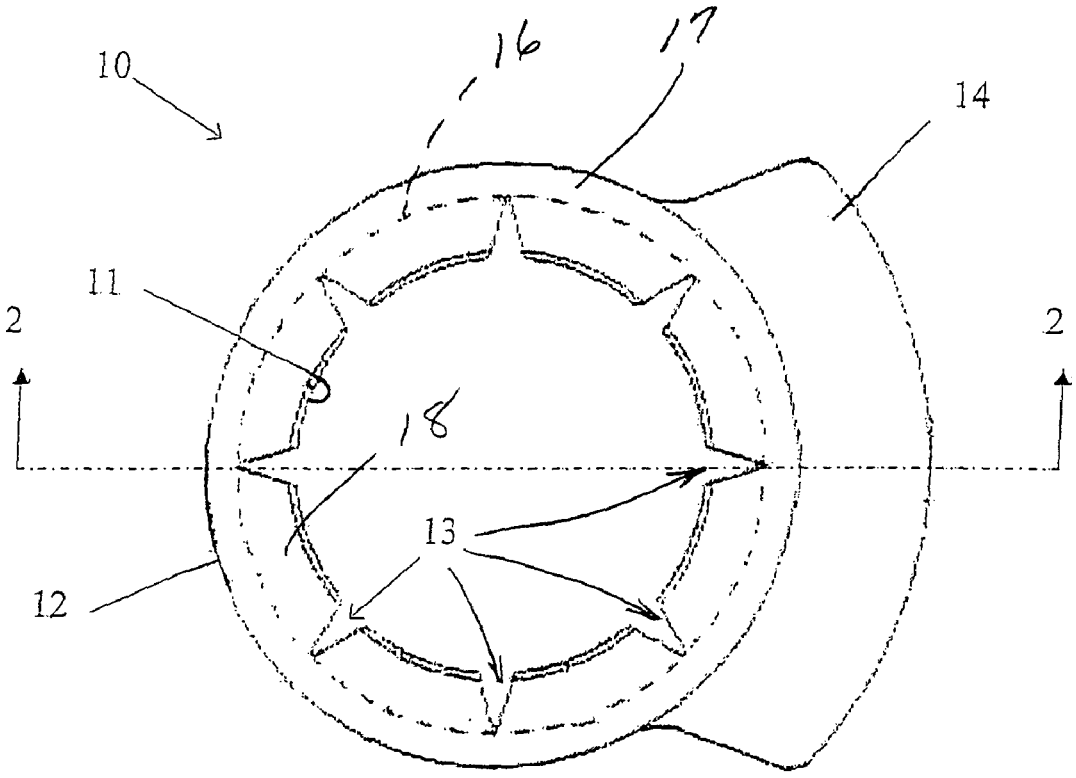
FIG. 1 is a top plan view of a first embodiment of a removable and reusable tag for identifying bottles, cans, and the like in accordance with this invention.
Figure 2:
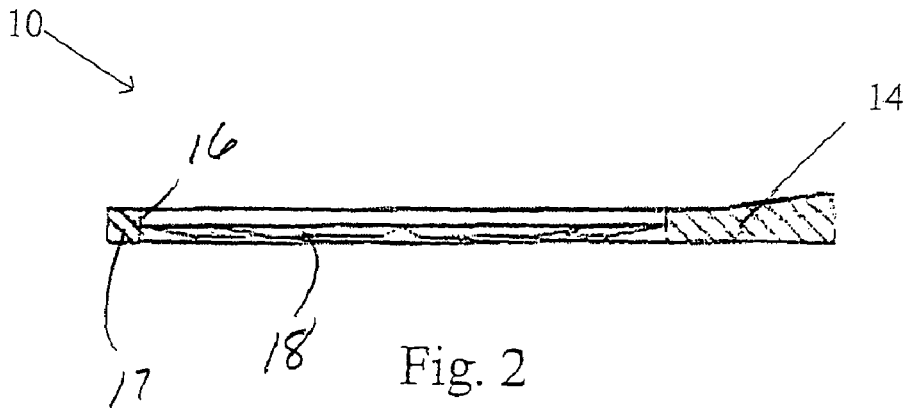
FIG. 2 sectional elevational view of the first embodiment of the removable and reusable tag taken along line 2-2 of FIG. 1.
Figure 3:
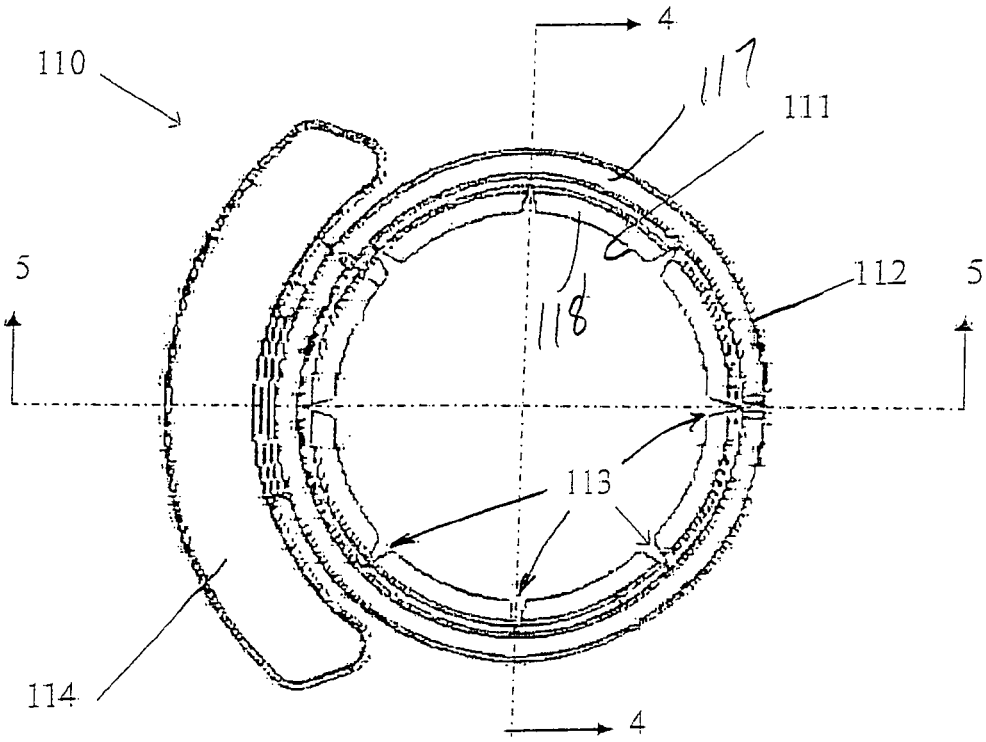
FIG. 3 is a top plan view of a second embodiment of a removable and reusable tag for identifying bottles, cans, and the like in accordance with this invention.

Referring now to the drawings, there is illustrated in FIGS. 1 and 2 a first embodiment of a removable and reusable tag, indicated generally at 10, for identifying bottles, cans, and the like in accordance with this invention. The illustrated tag 10 is generally flat and annular in shape, having an inner circumferential surface 11 and an outer circumferential surface 12. In the illustrated embodiment, the tag 10 has an inner radius of about 0.75 inch and an outer radius of about 1.125 inch. However, the tag 10 may be formed having any desired size and shape.

The inner circumferential surface 11 defines a central opening through the tag 10, the purpose of which will be explained below. A plurality of recesses, indicated generally at 13, are provided in the inner circumferential surface 11 of the illustrated tag 10. In the illustrated embodiment, eight of such recesses 13 are provided in the inner circumferential surface 11 of the illustrated tag 10. However, the tag 10 may be provided with any desired number of such recesses 13 or, alternatively, none of such recesses 13. Each of the illustrated recesses 13 is generally triangular in shape, having a pair of sides that are oriented at about a thirty degree included angle and terminate at a point that is located at an intermediate radius of about 1.00 inch. However, the recesses 13 may be formed having any desired shape or combination of shapes. An intermediate circumferential surface 16 defines a diameter inboard of and substantially concentric with the outer circumferential surface 12. The intermediate circumferential surface 16 may be coincident with the intermediate radius, though such is not required. The outer circumferential surface 12 and the intermediate circumferential surface 16 cooperate to define a ring portion 17 of the tag 10.

The ring portion 17, as illustrated in FIG. 2, has a substantially square cross sectional shape, although such is not required. The ring portion 17 may alternatively have a rectangular cross sectional shape, a triangular cross sectional shape, a circular cross sectional shape, or any other desired sectional shape. A tab portion 18 of the tag 10 is bounded by two adjacent recesses 13, an arc length portion of the inner circumferential surface 11, and an arc length of the ring portion 17. The tab portion 18 may preferably be the same radial width as the depth of the recess 13, though such is not required. In the illustrated embodiment, eight of such tab portions 18 of equal dimension are disposed around the ring portion 17, although any number of tabs 18 having any arc length dimension may be provided.

As shown in FIG. 2, the tag 10 further includes an identification portion 14. In the illustrated embodiment, the identification portion 14 is formed integrally with the tag 10, although such is not required. The identification portion 14 extends radially outward from the outer circumferential surface 12. The identification portion 14 extends around the outer circumferential surface 12 by an arc length that is less than the length of the outer circumferential surface, though such is not required. The identification portion 14 is provided to allow identifying indicia (not shown) to be associated with the tag 10. For example, such indicia may be formed integrally with the identification portion 14, such as by paint or embossment. Alternatively, such indicia may be releasably secured to the identification portion 14, such as by an adhesive label. Also, such indicia may be removably associated with the identification portion 14, such as by permanent marker, water-based ink marker, or pencil. The removably associated indicia are defined to be indicia directly applied to the identification portion 14 with the ability to be removed, thus returning the identification portion to a substantially original condition.

The tab portion 18 may, if desired, be of a tapering thickness as shown, progressing from a thinner section at the inner circumferential surface to a thicker section at the intermediate circumferential surface 16. The tabs 18, when configured with such a cross sectional shape, may be easily deflected to conform to the attaching portion of the container. Additionally, the resilient restoring force of the material causes the tabs 18 to deflect toward the container to frictionally secure the tag 10 thereto. The tabs 18 may also easily deflect away from any protruding surfaces of the container, such as, for example, the cap bead or rim adjacent to a bottle neck.

As best shown in FIG. 2, the identification portion 14 of the illustrated tag 10 has a thickness that is approximately equal to thickness of the ring portion 17 adjacent to the outer circumferential surface 12. The identification portion 14 transitions radially from the outer circumferential surface 12 to a relatively larger thickness than the thickness of the ring portion 17. However, the tag 10 may be formed having any desired thickness or combination of thicknesses, including a thickness that tapers from a relatively small thickness at the inner circumferential surface 11 to a relatively large thickness at the outer circumferential surface 12. Additionally, the identification portion 14 may include a surface texture formed thereon to promote the temporary transfer of releasably secured or removably associated indicia. Such a surface texture may range from a satin finish to a grainy, leather type texture. Alternatively, the identification portion 14 may be smooth.

The tag 10 is preferably formed from a flexible material, such as a plastic material. However, the tag 10 can be formed from any desired material. The tag 10 may alternatively be formed from a combination of materials, such as, for example, the identification portion 14 formed of metal and the ring portion 17 formed of plastic. The identification portion 14 may be integrally molded with the ring portion 17 or attached by way of a loop, clasp, or aperture formed therethrough.

In operation, a portion of a bottle or other container is inserted through the central opening defined by the inner circumferential surface 11. The recesses 13 provide the inner circumferential surface 11 with increased flexibility, allowing the portion of the container to be more easily inserted through the central opening. The tag 10 remains attached to the container due to frictional force between the inner circumferential surface 11 and the outer surface of the container or by larger diameter portions of the container preventing the tag 10 from easily slipping off.

Identifying indicia associated with tag 10 then allows identification of the container. Container identification may be made by way of associating the tag 10 having indicia thereon with a specific user in situations where a plurality containers may be collected together such as, for example, sporting events where fans congregating in the stands or players in a dugout or sideline area are consuming beverages, coworkers sharing space in an office refrigerator, or containers in camping and picnic coolers. Additionally, container identification may associate the tag 10 and indicia thereon with the container contents where a specific formulation is contained therein. Content identification may be important, for example, to segregate different baby bottle formulas, medicines, special dietary foods and beverages, and any contents having a readily unidentifiable appearance. When the user no longer wishes to use the container, the tag 10 is removed by extracting the container from the central opening defined by the inner circumferential surface 11.

The tag 10 may further provide identification through the use of different colors. The coloring may be an integral component of the material, such as various colored and moldable plastics, brass, chrome, zinc, or copper plated metals, and chrome plated plastics. Alternatively, the color may be applied by way of a paint, powder coat, or other coating that may also impart surface textures or characteristics that facilitate applying indicia onto the identification portion 14 of the tag 10.

Figure 4:
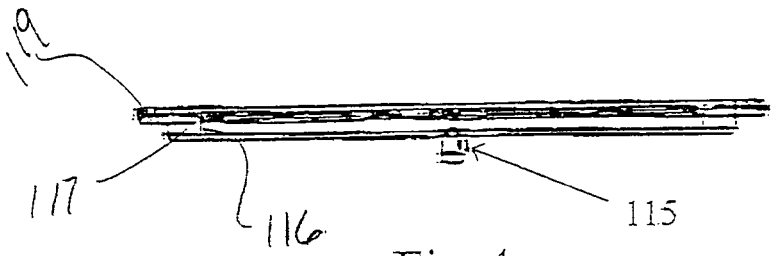
FIG. 4 is a sectional elevational view of the second embodiment of the removable and reusable tag taken along line 4-4 of FIG. 3.
Figure 5:
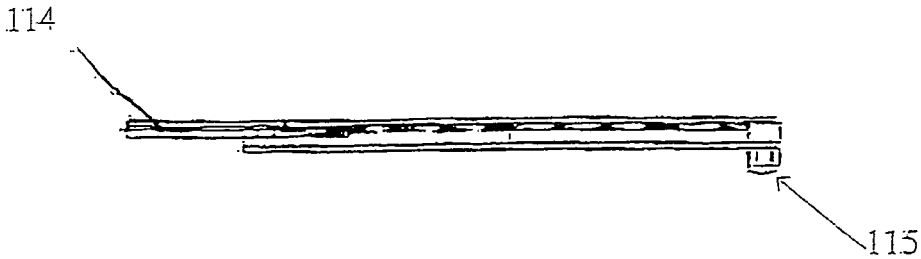
FIG. 5 is a sectional elevational view of the second embodiment of the removable and reusable tag taken along line 5-5 of FIG. 3.
Figure 6:
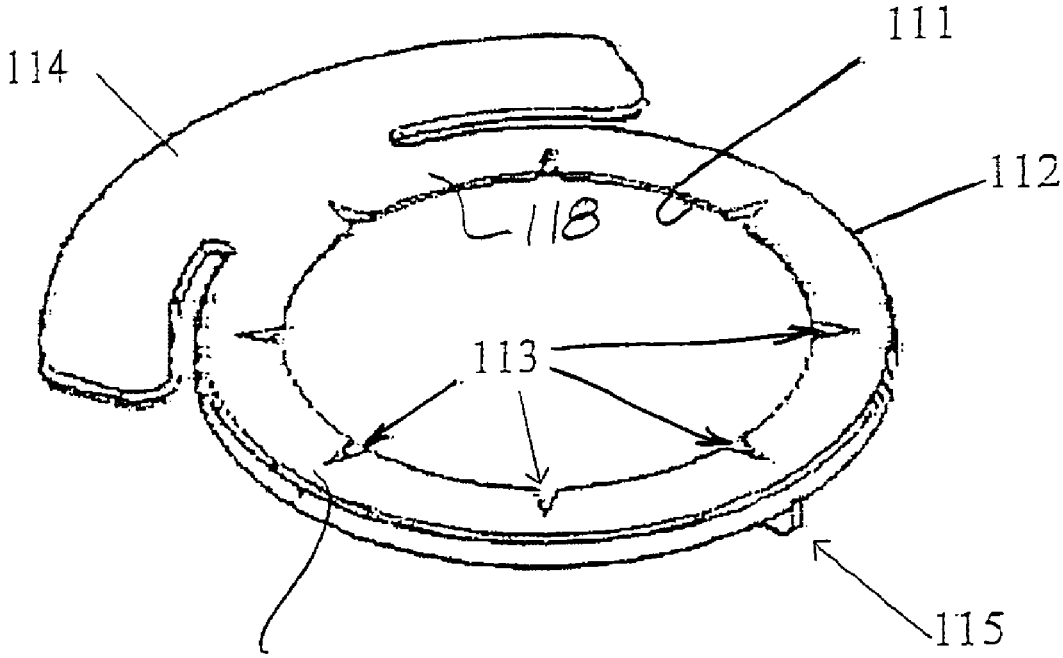
FIG. 6 is a perspective view of the second embodiment of the removable and reusable tag illustrated in FIGS. 3, 4, and 5.

FIGS. 3 through 6 illustrated a second embodiment of a removable and reusable tag, indicated generally at 110, for identifying bottles, cans, and the like in accordance with this invention. The second embodiment of the tag 110 is similar in many respects to the first embodiment of the tag 10, and reference numbers that have been increased by 100 are used to identify similar structures. In the second embodiment of the tag 110, the identification portion 114 is formed integrally with the outer circumferential surface 112 of the tag 110, but along only a portion of the length of the identification portion 114. The outer circumferential surface 112 and an intermediate circumferential surface 116 define a ring portion 117, as shown in FIG. 4. At least one tab 118 projects radially between the intermediate circumferential surface 116 and the inner circumferential surface 111. The ring portion 117 may include an extending flange 119 projecting radially outward for increased hoop strength. The second embodiment of the tag 110 also includes an area of increased thickness 115 of the outer circumferential surface 112. The thick area 115 is shown in FIGS. 3 through 6 in an orientation across from the identification tag 114. However, the thick area 115 may be positioned in any orientation around the tag 110. Additionally, the thick area 115 may include a plurality of thick areas positioned around the tag 110. The thick area 115 may provide additional increased hoop strength to the ring portion 117.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A removable and reusable tag for identifying a container comprising:

a ring portion having an outer circumferential surface and an intermediate circumferential surface;

a tab portion extending radially between the intermediate circumferential surface and an inner circumferential surface and circumferentially bounded by at least one recess provided therein; and an identification portion provided on the outer circumferential surface the identification portion having an outer surface;

wherein the identification portion includes a cross section having a smaller thickness at the outer circumferential surface that gradually transitions radially to a larger thickness at the outer surface thereof.

2. The tag defined in claim 1 wherein the ring portion has a substantially square cross section.

3. The tag defined in claim 1 wherein a plurality of tab portions are spaced about the intermediate circumferential surface.

4. The tag defined in claim 1 wherein the tab portion tapers radially from a thicker cross section at the intermediate circumferential surface to a thinner cross section at the inner circumferential surface.

5. The tag defined in claim 3 wherein the plurality of tabs is equally spaced about the intermediate circumferential surface.

6. The tag defined in claim 1 wherein the tab portion and the recess portion have substantially the same radial dimension.

7. The tag defined in claim 1 wherein the identification portion is integrally formed with the ring portion.

8. The tag defined in claim 1 wherein the identification portion extends around the outer circumferential surface by an arc length that is less than the length of the outer circumferential surface.

9. The tag defined in claim 1 wherein the identification portion is formed integrally with the outer circumferential surface along only a portion of the length of the identification portion.

10. The tag defined in claim 1 wherein the identification portion includes a cross section having a smaller thickness radially transitioning to a larger thickness.

* * * * *